US007073209B1

(12) United States Patent
McCormick

(10) Patent No.: US 7,073,209 B1
(45) Date of Patent: Jul. 11, 2006

(54) PASSIVE SANITIZING-TABLET DISPENSING DEVICE

(76) Inventor: Kevin McCormick, 3531 N. 33rd Ter., Hollywood, FL (US) 33021

( * ) Notice: Subject to any disclaimer, the term of this patent is extended or adjusted under 35 U.S.C. 154(b) by 0 days.

(21) Appl. No.: 11/131,596

(22) Filed: May 18, 2005

(51) Int. Cl.
*E03D 9/02* (2006.01)

(52) U.S. Cl. ..... 4/227.1; 4/227.5

(58) Field of Classification Search ..... 4/222, 4/227.1, 227.4, 227.5, 227.6
See application file for complete search history.

(56) References Cited

U.S. PATENT DOCUMENTS

| | | | | |
|---|---|---|---|---|
| 650,161 | A | 5/1900 | Williams et al. | |
| 2,950,959 | A * | 8/1960 | Ve Relle | 422/263 |
| 3,105,245 | A | 10/1963 | Finkbiner | |
| 3,290,698 | A | 12/1966 | Joyner et al. | |
| 3,444,566 | A | 5/1969 | Spear | |
| 3,545,014 | A | 12/1970 | Davis | |
| 3,588,926 | A | 6/1971 | Buck, Jr. | |
| 3,867,101 | A * | 2/1975 | Herring | 422/119 |
| 4,110,853 | A * | 9/1978 | dela Cruz | 4/227.4 |
| 4,129,230 | A | 12/1978 | Billett et al. | |
| 4,435,857 | A | 3/1984 | Meloy | |
| 4,507,812 | A | 4/1985 | Dubois et al. | |
| 4,709,423 | A | 12/1987 | Richards | |
| 5,603,126 | A * | 2/1997 | Scoggins | 4/225.1 |
| 5,778,459 | A | 7/1998 | Guerin | |
| 5,881,396 | A | 3/1999 | Rivera | |
| 6,240,572 | B1 | 6/2001 | Van Der Gaag et al. | |
| 6,339,850 | B1 | 1/2002 | Gore | |
| 6,651,260 | B1 | 11/2003 | Dodson | |
| 6,726,058 | B1 * | 4/2004 | Giraud | 221/267 |

* cited by examiner

*Primary Examiner*—David J. Walczak
*Assistant Examiner*—Huyen Le

(57) ABSTRACT

A device is claimed for passively dispensing sanitizing tablets in a container of water. Preferably the invention is applied to dispensing sanitizing tablets in a toilet tank, and means are described for positioning the device and controlling the amount of sanitizer dispensed per flush.

7 Claims, 2 Drawing Sheets

FIG. 2A
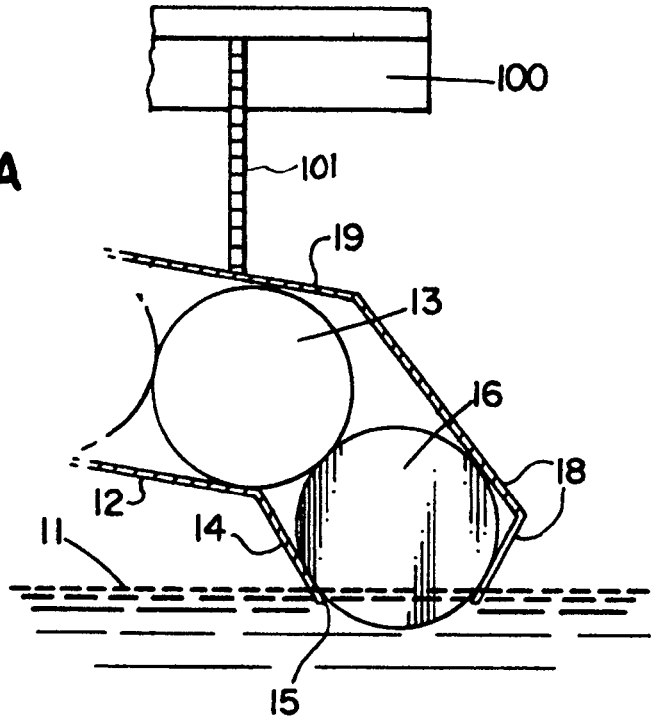
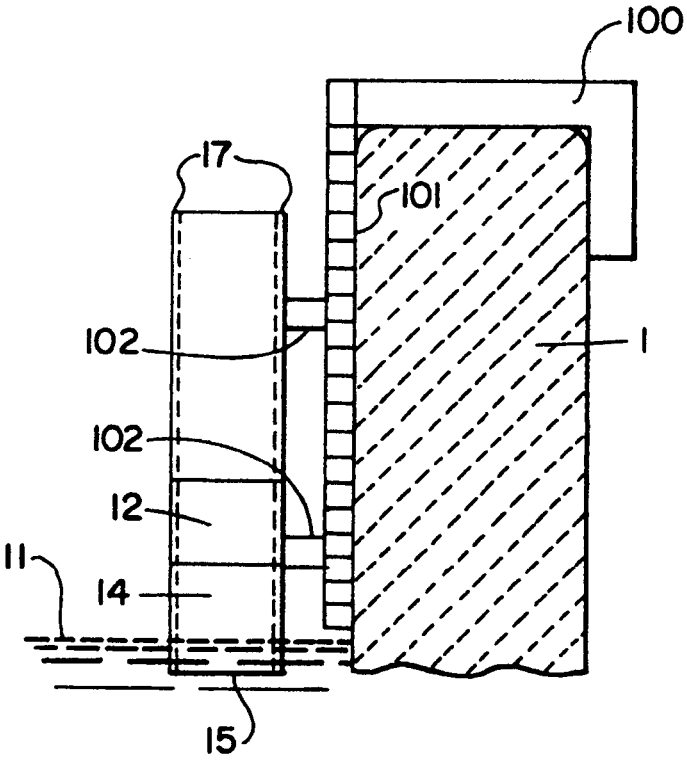
FIG. 2B

PASSIVE SANITIZING-TABLET DISPENSING DEVICE

FIELD OF THE INVENTION

This invention relates to the dispensing of sanitizing materials into water. More specifically, the invention relates to the dispensing of sanitizing tablets into a toilet tank.

BACKGROUND OF THE INVENTION

Inventors have been devising means of delivering disinfectants into toilets for over a century. U.S. Pat. No. 650,161 discloses a receptacle within a tank containing a disinfectant compound, with tubes in the receptacle arranged to prevent discharge of disinfectant until the toilet is flushed. U.S. Pat. No. 3,105,245 discloses a receptacle in a toilet bowl which contains solid chemical material, with solution fed into the receptacle and drained to the toilet bowl upon flushing. U.S. Pat. No. 3,290,698 teaches a container above the water level for chemical granules, with provision for spraying a portion of water over the granules with each flush through a screen into the toilet. U.S. Pat. No. 3,444,566 teaches a receptacle mounted on the overflow pipe with different chemical materials in separate chambers, with incoming water into a control chamber, then siphoned into chemical chambers, then siphoned back into the overflow pipe. U.S. Pat. No. 3,545,014 discloses sanitizer material in a flexible package, with water flowing into the package when the tank fills and out when the toilet flushes. U.S. Pat. No. 3,588,926 teaches a holder attached inside a toilet bowl containing germicidal tables with a larger opening on top for water and a smaller opening on the bottom for discharge. U.S. Pat. No. 4,129,230 discloses a tablet dispenser including a magazine holding a stack of tablets, a pusher to inject one tablet into a discharge chamber with an apertured wall to allow liquid to dissolve tablets. U.S. Pat. No. 4,435,857 discloses an apparatus for cleansing and disinfecting a toilet tank including a reservoir containing a disinfectant soluble in water, volume-control chamber, a delivery tube vented to atmosphere and a dispensing orifice. U.S. Pat. No. 4,507,812 teaches a dispenser for a solid substance into a toilet tank with a long, narrow cell communicating with a compartment which is divided into and communicating with a deep portion containing a solid substance. U.S. Pat. No. 4,709,423 teaches an in-tank dispenser comprising a chamber with lower and upper portions, the lower portion containing a disinfecting agent with an inlet/outlet pathway in the form of a U-shaped conduit. U.S. Pat. No. 5,603,126 discloses a toilet disinfectant dispenser comprising a rectangular container having inlet and outlet ports and containing a soluble disinfectant tablet and means for feeding some water from the float-valve assembly into the inlet port. U.S. Pat. No. 5,778,459 discloses a chemical injection apparatus comprising housing to receive refill water and an inner chamber containing a chemical tablet, a portion of the water passing through a dispensing hole to contaic the tablet and pass into a sump from which it is drawn by venturi into the refill water. U.S. Pat. No. 5,881,396 teaches a toilet cleaner controller device comprising a reservoir containing the cleaning chemical to receive water during refill, and a valve and outlet port to control flow of concentrated solution to the toilet. U.S. Pat. No. 6,240,572 B1 discloses a toilet bowl sanitizing apparatus comprising a container containing a plurality of sanitizing tablets, an intake pipe and an outlet pipe. U.S. Pat. No. 6,339,850 B1 teaches a vessel containing a supply of solid detergent and detergent solution, selective water supply to the vessel during filling of the tank, and means for delivering detergent to the tank when the toilet is flushed. U.S. Pat. No. 6,651,260 B1 teaches a lid for a toilet tank with an aperture containiing a mesh assembly for containin a toilet-cleaning tablet.

The multitude of approaches referenced above do not suggest the passive, simple and elegant device of the present invention.

SUMMARY OF THE INVENTION

A broad embodiment of the present invention is a device for passively dispensing a plurality of sanitizing tablets sequentially into a container of water. The device comprises a holding section substantially above a usual water level of the container attached to a dispensing section partially below the usual water level of the container. Each of the sections has a base comprising means for holding each of the plurality of tablets in sequential gravity contact within the combined sections. The base of the holding section comprises a plane sloping with respect to the surface of the water for conducting one or more of the tablets toward the dispensing section, and the base of the dispensing section positions at least one tablet partially submerged in water in the container through an opening in the dispensing section.

A more specific embodiment of the invention is a device for passively dispensing a plurality of sanitizing tablets sequentially into a toilet tank. The device comprises a holding section substantially above a usual water level of the toilet tank attached to a dispensing section partially below the usual water level of the tank. Each of the sections has a base comprising means for holding each of the plurality of tablets in sequential gravity contact within the combined sections. The base of the holding section comprises a plane sloping with respect to the surface of the water for conducting one or more of the tablets toward the dispensing section, and the dispensing section positions at least one tablet partially submerged in water in the tank through an opening in the dispensing section.

Yet another embodiment of the invention is a device for passively dispensing a plurality of sanitizing tablets sequentially into a toilet tank. The device comprises a holding section substantially above a usual water level of the toilet tank attached to a dispensing section partially below the usual water level of the tank. Each of the sections has a base comprising means for holding each of the plurality of tablets in sequential gravity contact within the combined sections. The base of the holding section comprises a plane sloping with respect to the surface of the water for conducting one or more of the tablets toward the dispensing section, and the dispensing section positions at least one tablet partially submerged in a cup of water in the tank through the dispensing section, the cup holding water which communicates with water in the tank.

BRIEF DESCRIPTION OF THE DRAWINGS

FIG. 2 is an illustration of the features of an embodiment of the passive sanitizing tablet-dispensing device.

DESCRIPTION OF THE PREFERRED EMBODIMENTS

Figure 1:
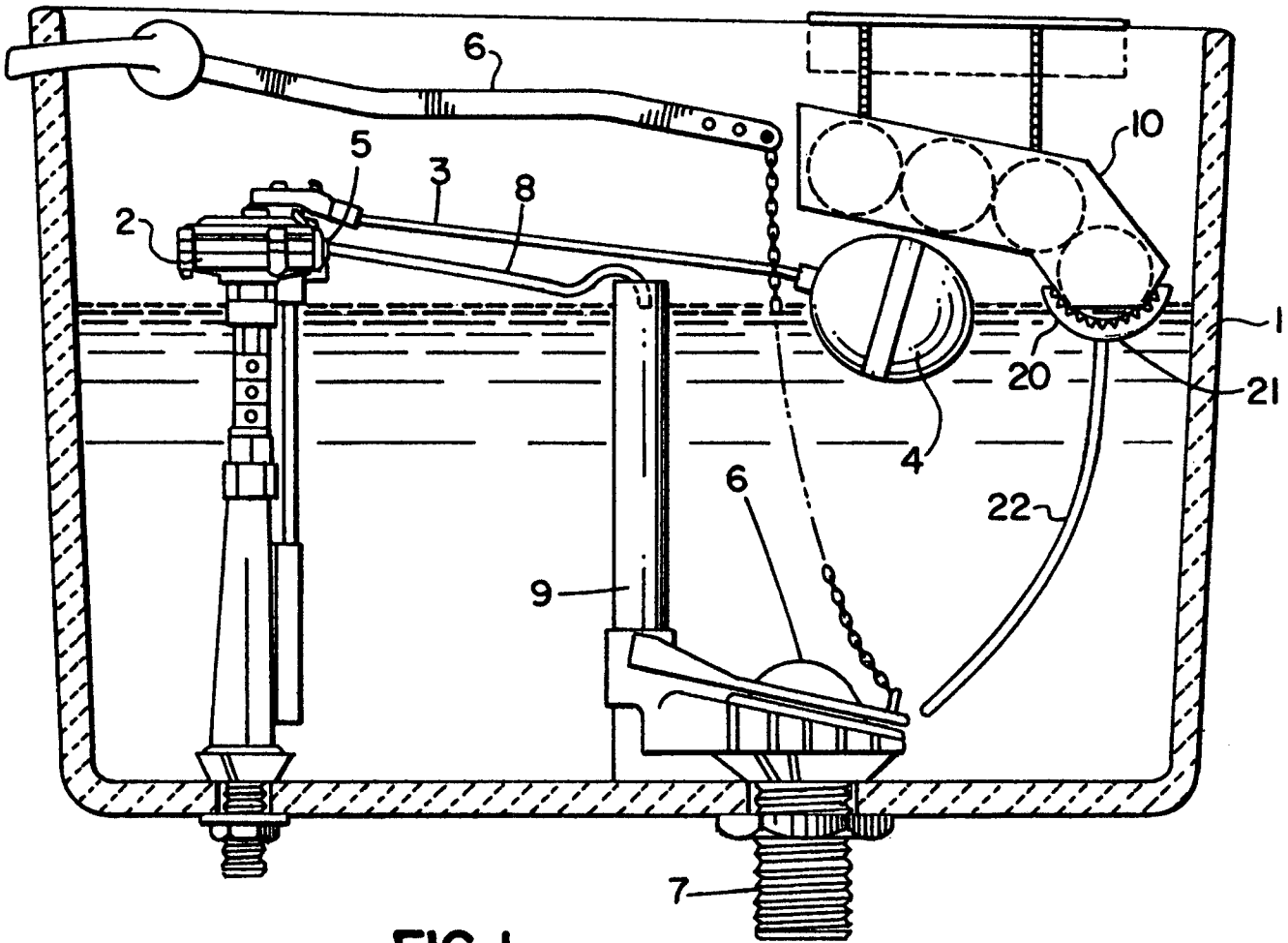
FIG. 1 is an illustration of an embodiment of the passive sanitizing tablet-dispensing device installed in a toilet tank.

The passive sanitizing tablet-dispensing device of the present invention can be used in any container of water wherein some treatment, purification or preservation of water through dissolution of a solid substance into the water is appropriate. Examples of the use of the container of water may be, without limiting the invention, for washing of items, bathing or swimming, or for flushing a toilet. The following description relates to installation of the device in a toilet tank, but do not exclude from the inventive concept other embodiments which may result from the modification of the description by a skilled routineer.

FIG. 1 is an illustration of the passive sanitizing tablet-dispensing device installed in a toilet tank 1 of the known art, the features of which are not limiting to the invention. The tank 1 has an interior for selectively holding flushing water. A fill unit 2 for controlling water flow from a water supply to the tank is mounted in the tank. A lever 3, coupled to a float 4, controls the fill valve 5. Conventional flushing mechanism 6 empties the tank into a tank outlet 7. The tank outlet is in fluid connection with a toilet bowl, whose features are well known and thus are not shown. A trickle conduit 8 in communication with the fill valve 5 squirts water into the overflow container 9. A passive sanitizing tablet-dispensing device 10 is described in more detail in FIG. 2.

FIG. 1 also illustrates an optional cup 20 for controlling the distribution of sanitizer-containing water into the toilet tank, cut away to show the dispensing section of the device. The cup, which is positioned in the tank beneath the dispensing section and which holds water communicating with water in the tank, contains only a fraction of the volume of water of the toilet tank and controls the distribution of sanitizer-containing water into the tank. A tablet usually will dissolve more thoroughly into a large toilet tank of water than it would dissolve into a much smaller cup of water, as saturation of dissolved sanitizer is achieved more rapidly in the cup which would retard further dissolution. The cup communicates with water in the tank through an opening 21, which advantageously is connected to a tube 22 through which water in the cup diffuses into water in the tank. If a toilet is flushed, for example, the tube could be positioned so that sanitized water is pulled through the tube by the suction of water flowing through tank outlet 7 into a toilet bowl; frequent flushes with less time for sanitizer to dissolve would result in a lower concentration of sanitizer in the tank and bowl than if the water was idle in tank and bowl over a long period of time.

FIG. 2 shows an embodiment of the passive sanitizing tablet-dispensing device in greater detail, along with one embodiment of a mounting device, in two views with respect to its position at the water level 11 of a container, here described as a toilet tank as in FIG. 1. FIG. 2*a* shows a side view of the device, while FIG. 2*a* shows an end-on view in parallel with the side of the container 1. Base 12 of a holding section for tablets comprises a plane sloping with respect to the level of the water in order to promote movement of tablets 13 toward base 14 of a dispensing section which is attached to and slopes downward from base 12. The base 14 of the dispensing section has an opening 15 through which tablet 16 contacts the water at level 11. Tablets 13 and 16 are in gravity contact with each other, moving down the slope as tablet 16 is dissolved in the water. The embodiment shown comprises side walls 17 on each side of the tablets which are connected at right angles to each of the holding section base 12 and dispensing section base 14, the side walls being parallel to each other at a distance which contains the tablets on the respective bases without hindering movement toward the water. The device optionally comprises one or both of end section 18 and top section 19 for partially or totally closing the tablets in the device. Tablets may be inserted into the device through an opening in the end section or top section, or both of these sections may be closed so that the device and tablets are a self-contained unit.

FIG. 2 also illustrates an embodiment of means to attach the device to a tank. A holder 100 attaches to the side of the tank, and is attached to zip ties 101 which are attached to the dispensing device by connectors 102. The zip ties permit the elevation and/or slope of the device in the tank to be adjusted.

The dispensing device of the invention may be fabricated of any of one or more materials suitable to accomplish the objectives described herein, including without limitation ceramics, metals and resinous or plastic materials. Preferably one or more resinous or plastic materials are used to fabricate the entire unit. Such materials include, without limitation, one or more of polyolefins such as polyethylene, polypropylene and polybutene; polyethylene terephthalate; polystyrene; polyvinyl chloride; and polyphenol. One or more of the polyolefins are particularly preferred materials. The device preferably is substantially transparent so that the number and condition of tablets remaining in the device can be observed.

The dispensing device may be positioned in the container of water by any suitable means, including attachment to the side of the container, to the base of the container, or by suspension above the container. Usually the dispensing device of the invention is mounted on a substantially vertical side of a container of water with side walls of the device usually parallel to the side of the container or toilet tank. The dispensing device may be attached to the container by any suitable attaching means, including without limitation zip ties, hooks, a support or mount, adhesives, screws or other connectors. Preferably the attaching means permit the elevation of the device to be adjusted in order to place the dispensing section at a level in the water to dissolve an appropriate amount of the tablet. The zip ties of FIG. 2 comprise one such attaching means. If the dispensing device and tablets are provided as a unit with an enclosed holding section, it is preferable that it is mounted in a manner that it can be easily replaced.

The plane of the base of the holding section of the tablet-dispensing device is at any suitable angle with respect to the level of the water that enables movement of the tablets toward the dispensing section by gravity as at least one tablet in the dispensing section dissolves in water. The angle also should be low enough that the device will not interfere with other features of the container; for example, so that the device can be placed in a toilet tank without impacting the cover of the tank. Means for holding the plurality of tablets in gravity contact within the device may comprise, for example, a side wall attached to the base or, preferably, two side walls attached vertically to the base and parallel to each other in order to hold tablets between the walls. When employing round tablets, a lower angle is possible than when employing tablets of another configuration, since round tablets can roll along the base of the holding section under the influence of gravity.

The dispensing device generally contains a plurality of tablets, i.e., two or more tablets of which at least one is in the dispensing section and one or more is in the holding section. The tablets are in gravity contact within the combined sections, that is, the tablets on the base are successively in contact via gravity pressure as the tablet in the dispensing section dissolves in water. Of course, at times only one tablet may be in the device in its dispensing section when the plurality of tablets are nearly spent.

The tablets contained in the device of the invention may be in any cross-sectional form and any size which can be dispensed by the device of the invention. A circular form, i.e., a low-rise cylinder, is preferred since this facilitates movement of the tablet along the plane of the holding base by rolling. Other geometric forms such as blocks of appropriate width for the side walls which can slide along the plane also are suitable. The size of the tablets should be concomitant with the dimensions of the dispensing device Without limiting the invention, a typical diameter of a cylindrical tablet for a toilet bowl can be in the range of from about 3 to about 10 cm with a cylinder height of from about 1 to about 4 cm.

The tablets may contain any materials known in the art which protect or improve the quality of the water, including without limitation disinfecting, cleaning, deodorizing and coloring agents. Suitable materials include for example hypochlorite salts, chloramines, chlorimines, chloramides, chlorimides, perborates, cyanuric acids, and hydantoins together with stabilizing salts, surfactants and matrix agents. In an optional embodiment, the last tablet in the dispenser to be dissolved is of a different color than the other tablets and/or the center of the tablets are of a different color than the outer section of the tablets in order that that the impending complete dissolution of the final tablet can be predicted. It is within the scope of the invention that the device may be employed alternatively to dispense other materials into water, e.g., fish food into a tank of fish or fertilizer into a tank used to dispense a fertilizer solution.

The above description and figures are intended to be illustrative of the invention without limiting its scope. The skilled routineer will readily understand how to extrapolate parameters of the disclosure to other embodiments of the invention. The invention is limited only by the claims set forth herein.

I claim:

1. A passive tablet-dispensing device positioned in a toilet tank for dispensing successively two or more sanitizing tablets into the tank, each tablet in gravity contact with at least one other tablet, the device having a holding section substantially above a usual water level of the tank and a dispensing section partially below the usual water level of the tank, each of the sections comprising means for holding each of the plurality of tablets in sequential gravity contact within the combined sections, the holding section comprising a base consisting essentially of a plane sloping with respect to the surface of the water for conducting one or more of the tablets toward the dispensing section, and the dispensing section positioning at least one tablet partially submerged in water in the tank through an opening in the dispensing section.

2. The device of claim 1 wherein the means for holding each of the tablets in sequential gravity contact comprises side walls on each side of the tablets which are connected at right angles to each of the holding section base and dispensing section base.

3. The device of claim 1 wherein the device is substantially transparent.

4. The device of claim 1 further comprising a cup positioned in the tank beneath the dispensing section which holds water communicating with water in the tank.

5. The device of claim 1 wherein the device and tablets are provided as a unit with an enclosed holding section.

6. The device of claim 1 wherein the last tablet in the dispenser to be dissolved is of a different color than the other tablets.

7. A passive tablet-dispensing device positioned in a toilet tank for dispensing successively two or more sanitizing tablets into the tank, each tablet in gravity contact with at least one other tablet, the device having a holding section substantially above a usual water level of the tank and a dispensing section partially below the usual water level of the tank, each of the sections comprising means for holding each of the plurality of tablets in sequential gravity contact within the combined sections, the holding section comprising a base consisting essentially of a plane sloping with respect to the surface of the water for conducting one or more of the tablets toward the dispensing section, the dispensing section positioning at least one tablet partially submerged in water through an opening in the dispensing section, and a cup positioned in the tank beneath the dispensing section holding water and connected to a tube through which water is pulled by the suction of water flowing into a toilet bowl.

* * * * *